US007428830B2

(12) United States Patent
Matsukura et al.

(10) Patent No.: US 7,428,830 B2
(45) Date of Patent: Sep. 30, 2008

(54) WASHING MACHINE WITH VIBRATION DETECTING UNIT

(75) Inventors: Toyotsugu Matsukura, Nara (JP); Takashi Komatsu, Hyogo (JP); Shigeru Matsuo, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 559 days.

(21) Appl. No.: 11/142,459

(22) Filed: Jun. 2, 2005

(65) Prior Publication Data

US 2006/0048549 A1 Mar. 9, 2006

(30) Foreign Application Priority Data

Sep. 6, 2004 (JP) ..... 2004-257921

(51) Int. Cl.
*D06F 33/02* (2006.01)
*D06F 37/22* (2006.01)

(52) U.S. Cl. ..... 68/12.04; 68/12.06; 68/23.1; 68/24

(58) Field of Classification Search ..... 68/12.06, 68/12.16, 23.1, 24
See application file for complete search history.

(56) References Cited

U.S. PATENT DOCUMENTS

| | | | | |
|---|---|---|---|---|
| 3,152,462 | A * | 10/1964 | Elliott et al. | 68/12.02 |
| 5,767,670 | A | 6/1998 | Maher et al. | |
| 6,470,751 | B1 | 10/2002 | Baek | |

FOREIGN PATENT DOCUMENTS

| | | |
|---|---|---|
| CN | 1264828 A | 8/2000 |
| CN | 1500933 | 6/2004 |
| DE | 1235629 | 3/1967 |
| EP | 0 294 014 | 12/1988 |
| EP | 1 036 875 | 8/2004 |
| FR | 2581091 | 10/1986 |
| GB | 2 348 961 | 10/2000 |
| GB | 2 357 855 | 7/2001 |
| JP | 61-98286 | 5/1986 |
| JP | 06-170080 | 6/1994 |
| JP | 6-246087 | 9/1994 |
| JP | 9-269264 | 10/1997 |
| JP | 2004-242735 | 9/2004 |

* cited by examiner

*Primary Examiner*—Joseph L Perrin
(74) *Attorney, Agent, or Firm*—Bacon & Thomas P.L.L.C.

(57) ABSTRACT

A washing machine includes a rotary drum, a water tub, a supporting metallic part, a washing machine base, a motor, a controller, and a vibration detecting unit. The vibration detecting unit, inclusive of a differential transformer having a plurality of coils and a magnetic body, is disposed between the supporting metallic part and the washing machine base and detects a vibration of the water tub.

5 Claims, 5 Drawing Sheets

WASHING MACHINE WITH VIBRATION DETECTING UNIT

FIELD OF THE INVENTION

The present invention relates to a washing machine; and, more particularly, to a washing machine for performing washing, rinsing and water-extracting processes of laundry in a rotary drum having a substantially horizontal or slanted rotational axis.

BACKGROUND OF THE INVENTION

A conventional washing machine includes a rotary drum, having a substantially horizontal or slanted rotational axis, for accommodating laundry therein; a water tub that incorporates the rotary drum therein and is supported in a washing machine main body; a supporting metallic part for supporting the water tub; a washing machine base for supporting the washing machine main body; a motor for rotating the rotary drum; an input setup unit for setting up operations of the washing machine; and a controller for controlling a washing operation of the washing machine set up by the input setup unit and controlling the motor. Under the control of the controller, washing, rinsing and water-extracting processes of the washing machine are regulated precisely.

When the washing and rinsing processes are completed, laundry in the rotary drum contains water therein, so the water-extracting process is performed to remove water from the laundry by way of rotating the rotary drum. At this time, however, the laundry articles may be placed in an imbalanced state within the rotary drum with regard to the rotation movement during the water-extracting process depending on the types, materials and shapes thereof. In such a case, the rotary drum and the like would vibrate considerably, thereby making noise.

Thus, in order to detect an abnormal vibration during the water-extracting process, it has been proposed to accommodate the laundry and detergent in a rotary drum supported rotatably in an inner frame, the inner frame being in turn supported in an outer frame by a buffering structure such as a spring, and to detect a mechanical vibration of the inner frame by means of a vibration detecting unit disposed in the outer frame (see, for example, Japanese Patent Laid-open Application No. S61-98286: Reference 1).

In this method, the water-extracting process is performed by executing first a balancing operation of rotating the rotary drum with a motor driven at a low speed so that the laundry accommodated in the rotary drum is uniformly attached to the inner wall of the rotary drum by a centrifugal force, and then rotating the rotary drum at a higher rotational speed. If an abnormal vibration occurs during these steps, the rotary drum is immediately stopped.

Further, there have been proposed other methods for detecting an abnormal vibration due to an imbalanced distribution of laundry in a rotary drum before rotating the rotary drum at a high rotational speed, to thereby enable an execution of a safe and high-efficiency water-extracting process. For example, Japanese Patent Laid-Open Application No. H6-170080 (Reference 2) discloses a method for detecting an abnormal vibration of a washing machine that includes an induction motor for rotating a rotary drum and an inverter circuit for driving the induction motor. In the method, a washing operation where the rotary drum is rotated in forward and backward directions, a balancing operation where the rotary drum is rotated at a low rotational speed, and a water-extracting operation where the rotary drum is rotated at a high rotational speed are successively performed in the order. Upon starting the balancing operation, an effective current is detected from an output of the inverter circuit, and a difference of current is calculated between the maximum value and the minimum value of the effective current. Then, the calculated difference of current is compared with a preset threshold current value representing an excessive vibration. If the difference of current exceeds the preset threshold, an excessive vibration is detected based on the current, and a warning of an occurrence of excessive vibration is outputted.

However, in case of the configuration disclosed in Reference 1, during the balancing operation wherein the rotary drum is rotated at a low rotational speed, an abnormal vibration may not yet be detected due to the small amplitude of a mechanical vibration, even if there is an imbalanced distribution of laundry articles within the rotary drum. Since the amplitude of the vibration does not become large enough to be detected until the rotational speed of the rotary drum is increased to a high rotational speed, it may be difficult to detect the occurrence of the abnormal vibration before rotating the rotary drum at the high rotational speed. Accordingly, the rotary drum can be stopped only after the abnormal vibration has already occurred. Therefore, there is a high risk that the laundry or the washing machine may be subject to a damage, and an unnecessarily greater amount of time may be required until the rotary drum is stopped.

Further, the method of Reference 2, which detects an abnormal vibration indirectly from an effective current of the induction motor, is based on the assumption that an imbalance of laundry is reflected on the effective current of the induction motor and that the imbalanced state leads to an abnormal vibration. However, a variation of the effective current of the induction motor can be caused not only by an imbalanced distribution of laundry within the rotary drum but also by mechanical factors, e.g., due to a bearing of the induction motor or the like. Further, since an occurrence of an excessive vibration is determined by comparing the variation in the effective current with a preset threshold current value, excessive vibration warnings may be issued more often than necessary, thereby stopping the rotary drum too frequently.

SUMMARY OF THE INVENTION

It is, therefore, an object of the present invention to provide a washing machine capable of preventing an occurrence of an abnormal vibration or noise due to an imbalanced distribution of laundry in a rotary drum during a water-extracting process.

In accordance with the present invention, there is provided a washing machine including: a rotary drum having a substantially horizontal or slanted rotational axis, for accommodating laundry therein; a water tub movably supported in a washing machine main body, for accommodating the rotary drum therein rotatably; a supporting metallic part for supporting the water tub; a washing machine base for supporting the washing machine main body; a motor for rotating the rotary drum; a controller for controlling the motor; and a vibration detecting unit disposed between the supporting metallic part and the washing machine base, for detecting a vibration of the water tub, wherein the vibration detecting unit includes a differential transformer having a plurality of coils and a magnetic body.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described with reference to the accompanying drawings. That the description is intended to further illustrate, but not limit, the present invention.

First Preferred Embodiment

Figure 1:
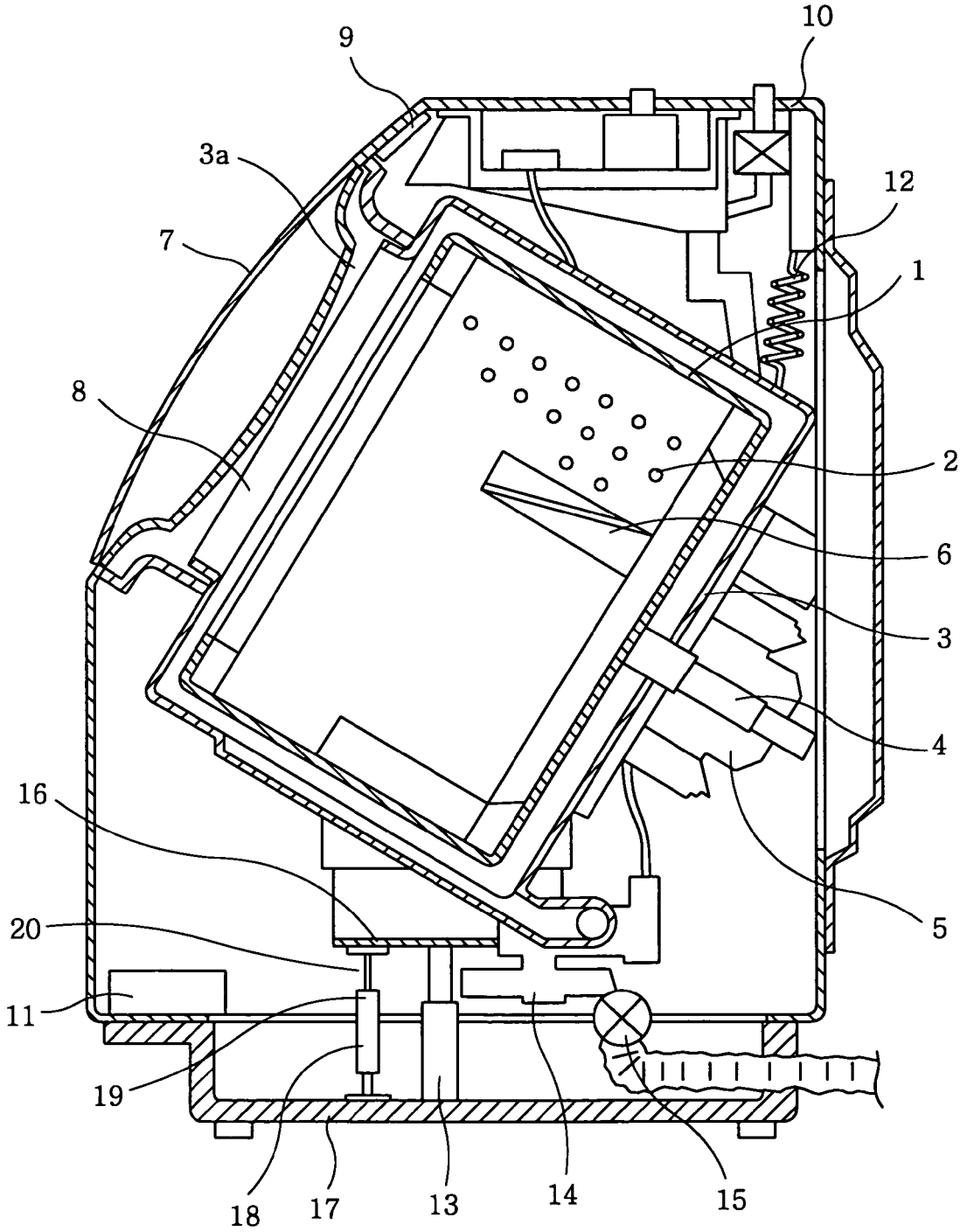
FIG. 1 represents a cross sectional view of a washing machine in accordance with a first preferred embodiment of the present invention.
Figure 2:
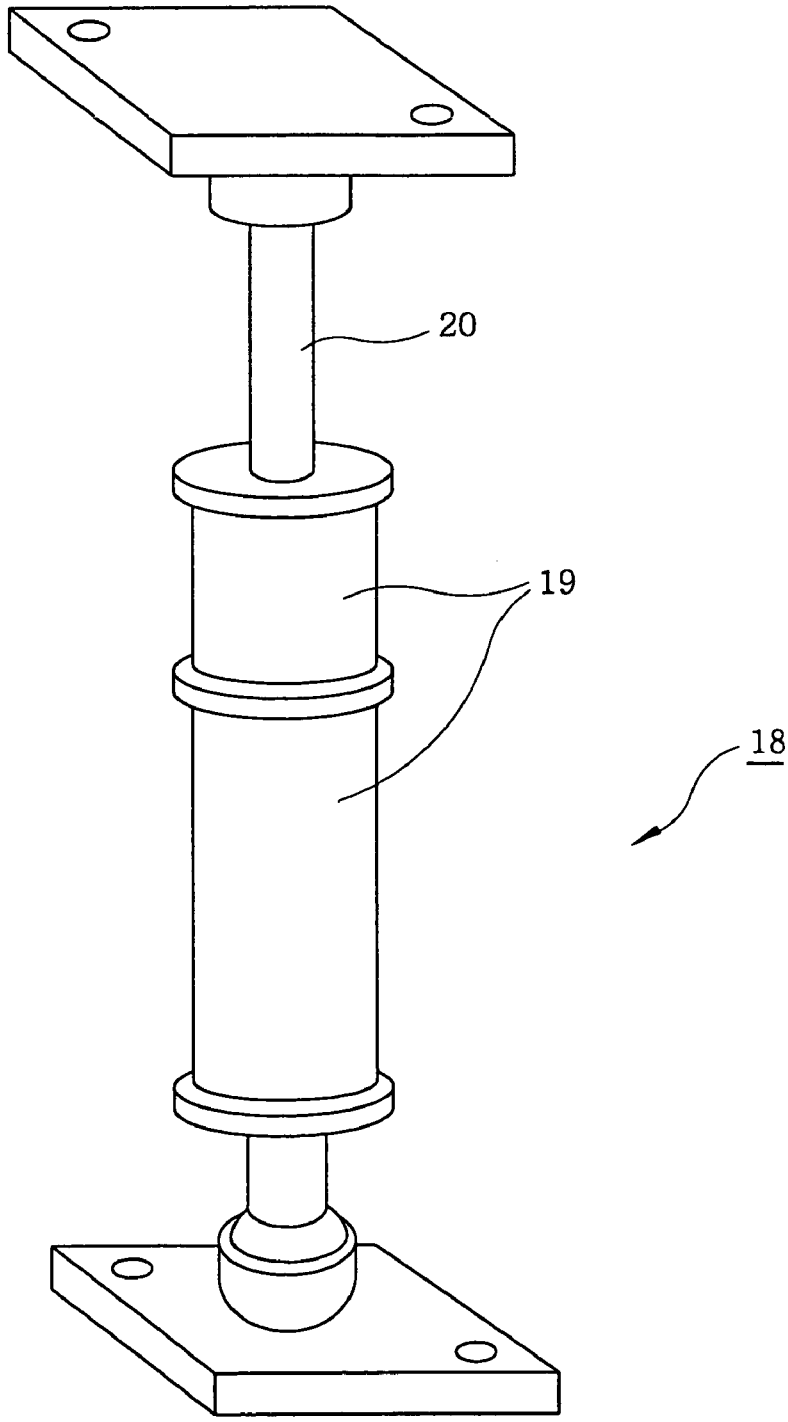
FIG. 2 sets forth a perspective view of a vibration detecting unit of the washing machine in accordance with the first preferred embodiment.

FIG. 1 is a side cross sectional view of a washing machine in accordance with a first preferred embodiment of the present invention and FIG. 2 presents a perspective view of a vibration detection unit used therein.

As shown in FIG. 1, cylindrical rotary drum 1 having a bottom surface and provided with multiple drum perforations 2 on its cylindrical surface is rotatably installed in water tub 3. Rotary drum 1 is also provided with rotating shaft (central axis of rotation) 4 and is disposed such that the direction of its rotational axis is declined toward a rear portion of the washing machine. Further, motor 5 installed at a rear portion of water tub 3 is connected to rotating shaft 4, and rotary drum 1 is driven by motor 5 to rotate in forward and backward directions.

Agitation blades 6 are disposed on an inner cylindrical surface of rotary drum 1. Further, water tub 3 is provided with opening 3*a* at an inclined surface of a front portion thereof which faces upward, and opening 3*a* can be opened or closed with door 7. By opening door 7, laundry can be loaded into or unloaded from rotary drum 1 through laundry loading/unloading opening 8. Since door 7 is installed at the inclined surface facing upward, loading and unloading of laundry can be done without forcing a user to bend down inconveniently.

Input setup unit 9 for setting up, for example, an operation course of washing machine main body 10 is prepared above door 7. And, disposed in a front lower portion of washing machine main body 10 is controller 11 for receiving input information from input setup unit 9 and controlling the operation of motor 5 and so forth based on the input information. Controller 11 includes a microcomputer for controlling a series of operations including washing, rinsing, and water-extracting processes.

Further, water tub 3 is movably supported in washing machine main body 10 via spring 12 and damper 13, and one end of drain hose 14 is connected to a bottom portion of water tub 3. The other end of drain hose 14 is coupled to drain valve 15 to drain washing water from water tub 3. In addition, supporting metallic part 16 for supporting water tub 3 is installed at a bottom portion of water tub 3, and vibration detecting unit 18 for detecting a vibration of water tub 3 is installed between supporting metallic part 16 and washing machine base plate 17, which is one of the bottom components of the washing machine. Vibration detecting unit 18 is a differential transformer including a plurality of coils 19 and magnetic body 20, as shown in FIG. 2.

The operation and function of the washing machine with the above-described configuration will now be described. When the washing and rinsing processes are completed, laundry in rotary drum 1 is still wet, so the water-extracting process is performed to extract water from the laundry by way of rotating rotary drum 1. During the water-extracting process, however, the laundry may be distributed in an imbalanced manner within rotary drum 1 depending on the type, material and shape of the laundry. In such a case, rotary drum 1 may vibrate considerably, which in turn may make water tub 3, accommodating rotary drum 1 therein, vibrate, too.

As described earlier, installed between supporting metallic part 16 that supports water tub 3 and washing machine base plate 17 is vibration detecting unit 18 for detecting a vibration. Further, vibration detecting unit 18 is formed of a differential transformer including coils 19 and magnetic body 20. Coils 19 are fixed on washing machine base plate 17, while magnetic body 20 is secured to supporting metallic part 16 installed at water tub 3. Since magnetic body 20 is configured to move vertically in response to a vibration of rotary drum 1, voltages are generated in coils 19 as a function of a displacement of magnetic body 20. In this way, detection of a vibration is possible. Moreover, it is also possible to detect the weight of the laundry in rotary drum 1 by using a displacement measurement obtained from vibration detecting unit 18 when the laundry is loaded into rotary drum 1 before starting the washing of the laundry.

While executing a series of washing operations programmed by input setup unit 9, controller 11 may regulate the operations based on a vibration level detected by vibration detecting unit 18. To be more specific, controller 11 may reduce the rotational speed of motor 5 if the vibration level is within a predetermined range, that is, if the vibration level is not greater than a first predetermined value but exceeds a second predetermined value. Further, if the vibration level is abnormally high, that is to say, if the vibration level exceeds the first predetermined value, it may stop the rotation of motor 5, or may stop the rotation of motor 5 temporarily and then resume its rotation at a low rotational speed, to thereby redistribute the off-balance laundry. As a consequence, abnormal vibration or noise of rotary drum 1 and so forth can be prevented. Furthermore, since the weight of the laundry in rotary drum 1 can be obtained from the level detected by vibration detecting unit 18, the amount of water to be supplied during the washing process or rinsing process can be adjusted based on the detected level.

Second Preferred Embodiment

Figure 3:
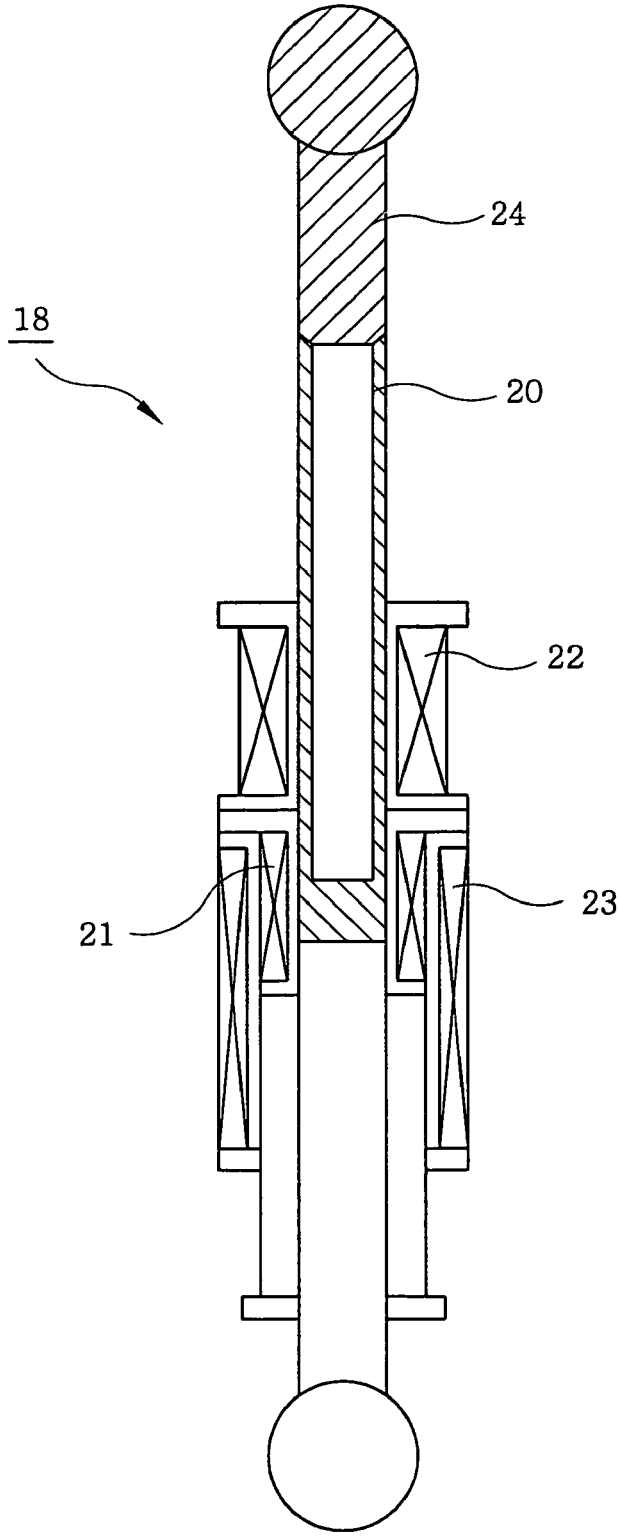
FIG. 3 provides a cross sectional view of a vibration detecting unit of a washing machine in accordance with a second preferred embodiment of the present invention.
Figure 4:
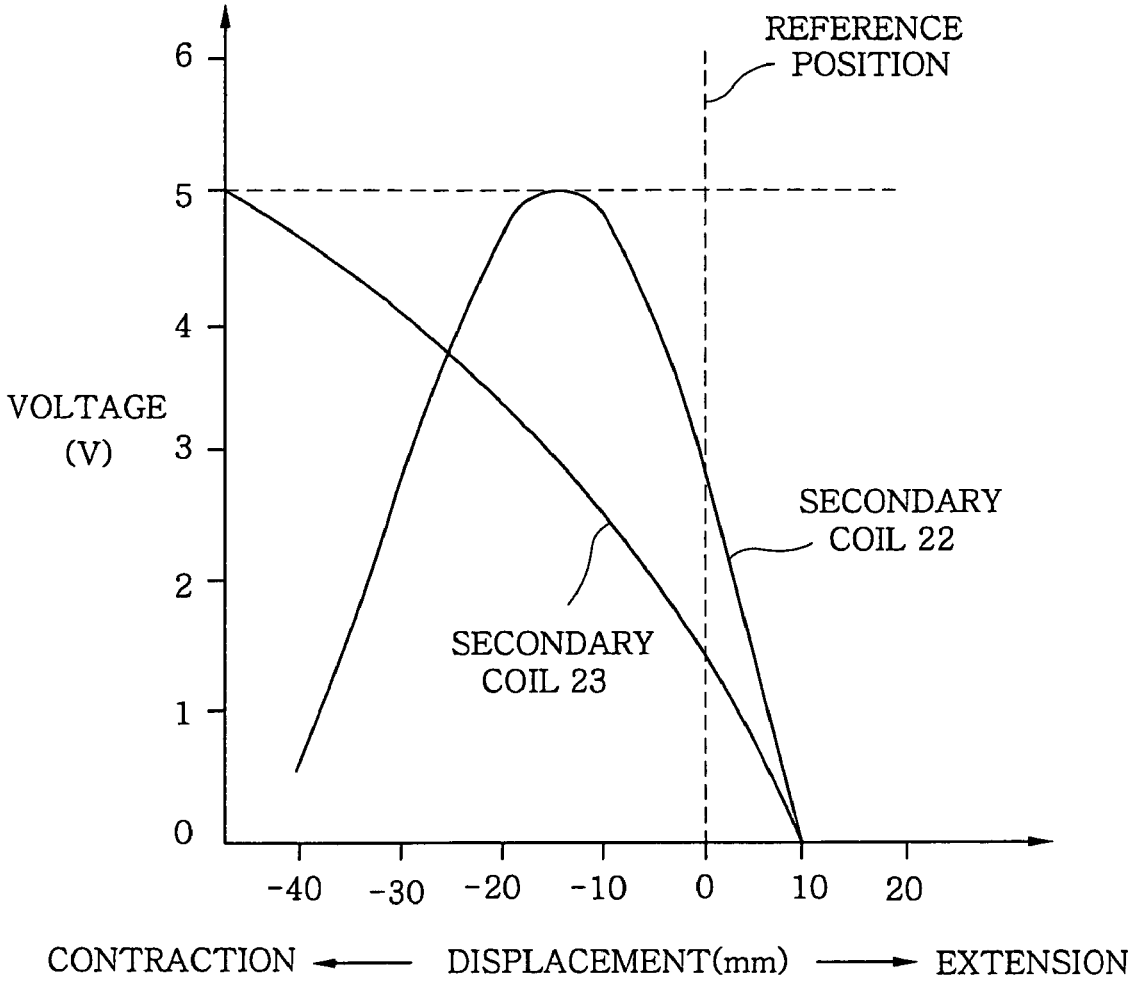
FIG. 4 presents a graph describing the characteristic features of the vibration detecting unit in accordance with the second preferred embodiment.

FIG. 3 is a cross sectional view of a vibration detecting unit of a washing machine in accordance with a second preferred embodiment of the present invention, and FIG. 4 shows a graph describing characteristics of the vibration detecting unit. Further, parts identical to those described in the first preferred embodiment will be designated with like reference numerals, and description thereof will be omitted.

In the second preferred embodiment, vibration detecting unit 18 is formed of, e.g., three coaxial coils and a magnetic body, as shown in FIG. 3. Specifically, one of the three coils is primary coil 21 for input, and the other two are secondary coils 22 and 23 for output, respectively. Further, shaft-shaped magnetic body 20 is embedded in shaft 24 made of a non-magnetic material such as a synthetic resin to pass through the three coaxial coils. Shaft 24 having magnetic body 20 therein moves vertically in an axial direction.

As for the positional relationship between the three coils and magnetic body 20, secondary coil 22 is disposed at a side where vertically moving shaft 24 is inserted, and primary coil 21 is disposed adjacent to secondary coil 22. Further, another secondary coil 23 is installed to surround primary coil 21 and to be adjacent to secondary coil 22. A position where the lower end of magnetic body 20 in shaft 24 is within the range of primary coil 21 is defined as a reference position for a vertical vibration of shaft 24. The winding number of secondary coil 22 is set to be approximately ten times that of primary coil 21 while the winding number of secondary coil 23 is set to be about 7 times that of primary coil 21. The length of magnetic body 20 is set to be longer than the winding width of secondary coil 23.

Referring to FIG. 4, there is shown a graph describing the characteristics of vibration detecting unit 18. The graph shows a relationship between a vertical displacement of shaft 24 from the reference position and a secondary voltage for each of the secondary coils, wherein an input of the primary coil is regulated constant and shaft 24 including magnetic body 20 is moved up (direction of extension) and down (direction of contraction).

The operation and function of vibration detecting unit 18 with the above-described configuration will now be described.

As can be seen from the graph in FIG. 4, the relationship between a displacement triggered by a movement of shaft 24 having magnetic body 20 therein and the output voltage of secondary coil 22 forms a virtually straight line with a large slope within a range from about 10 mm in the extension side to about 10 mm in the contraction side when the input of primary coil 21 remains constant, while obtaining a maximum value of the output voltage at about 15 mm in the contraction side. Given that the range from 10 mm in the extension side to 10 mm in contraction side is a range of displacements where shaft 24 moves when laundry is loaded into rotary drum 1, secondary coil 22 may be considered adequate for use in detecting the weight of laundry. That is to say, a more precise detection of laundry weight can be realized with secondary coil 22 because a slope of voltage per a unit displacement is large in spite of the narrow range of detection.

Further, the relationship between the displacement due to the movement of shaft 24 having magnetic body 20 therein and the output voltage of secondary coil 23 forms a virtually straight line within a range from about 10 mm in the extension side to about 40 mm in the contraction side when the input of primary coil 21 remains constant. Given that the range from 10 mm in the extension side to 40 mm in the contraction side is a range of displacements where shaft 24 moves when laundry is loaded into rotary drum 1 and water is supplied thereinto up to a maximum level during the washing process, secondary coil 23 may be considered adequate for use in detecting a vibration. That is to say, a more precise detection of a vibration during the operations can be achieved with secondary coil 23 because it has a wide detection range and a small slope of voltage per a unit displacement does not matter in this case.

In accordance with the second preferred embodiment of the present invention described above, by varying the winding numbers of two secondary coils 22 and 23, the relationships between the displacements of shaft 24 including magnetic body 20 and the respective output voltages of secondary coils 22 and 23 are changed. Thus, it is possible to use one secondary coil 22 for the detection of laundry weight, while employing the other secondary coil 23 to detect a vibration.

Third Preferred Embodiment

Figure 5:
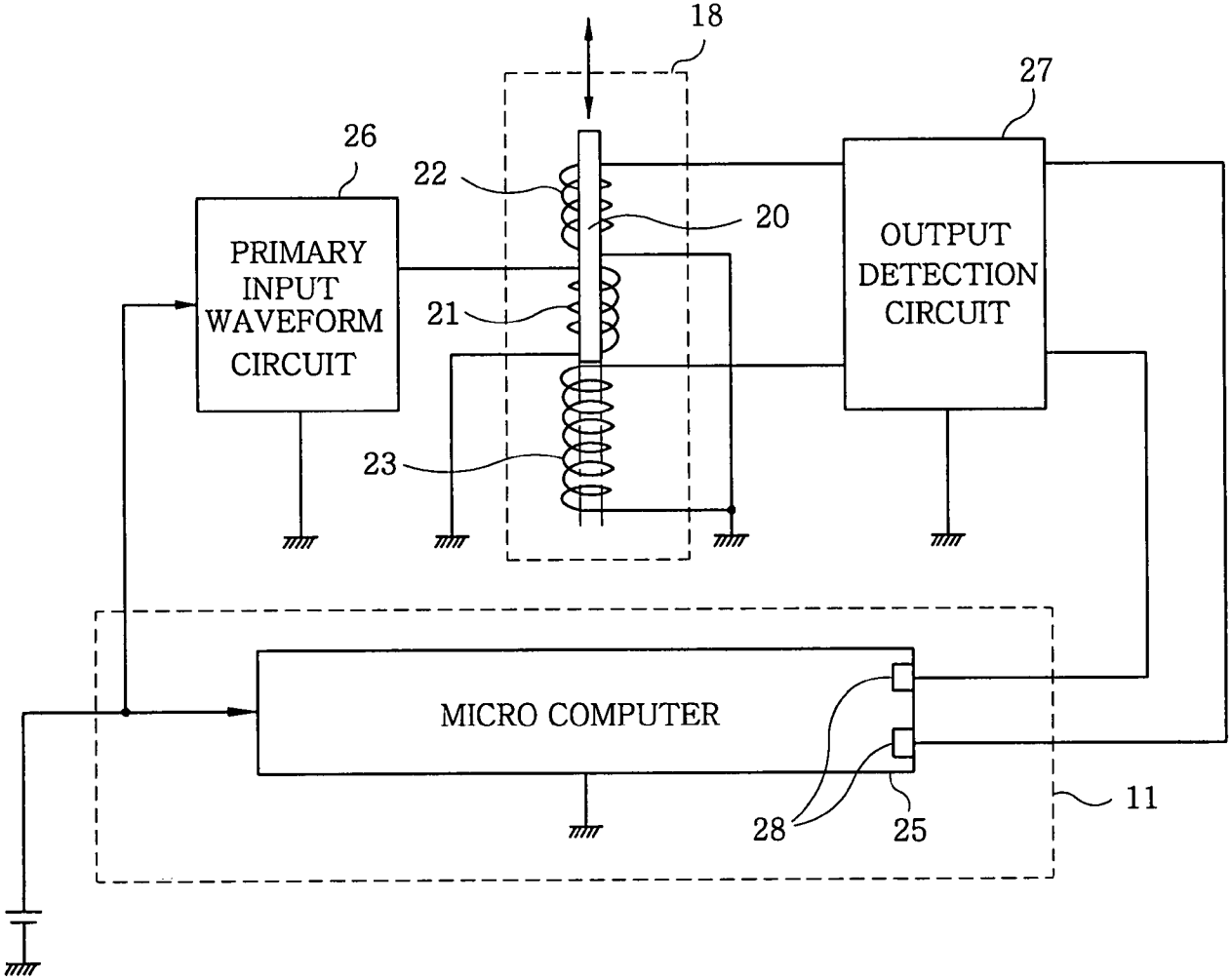
FIG. 5 shows a circuit diagram of a vibration detecting unit for use in a washing machine in accordance with a third preferred embodiment of the present invention.

Referring to FIG. 5, there is provided a circuit diagram of a vibration detecting unit for use in a washing machine in accordance with a third preferred embodiment of the present invention.

In FIG. 5, primary input waveform circuit 26 generates a triangular wave with a voltage supplied to microcomputer 25 of controller 11 that controls operations of the washing machine set up by input setup unit 9 and controls motor 5, and then inputs thus generated triangular wave to primary coil 21. Outputs of two secondary coils 22 and 23 depending on the position of magnetic body 20 are rectified and smoothed in output detection circuit 27. Then voltages of thus rectified and smoothed outputs are set to be not greater than the voltage supplied to microcomputer 25 and are inputted to A/D conversion ports 28 of microcomputer 25. The other structures are identical to those described in the first and the second preferred embodiments, and detailed description thereof will be omitted.

In the above configuration, it is preferable that an input waveform of primary coil 21 of vibration detecting unit 18 is a sine wave. However, many components are required to generate a sine wave with the voltage supplied to microcomputer 25, and, therefore, it may be cost-ineffective and space-consuming. Alternatively, therefore, one way considers to divide a square wave of microcomputer 25 and supply them to primary coil 21. In this method, however, inductance of primary coil 21 may affect secondary coils 22 and 23, which may cause generation of resonant waveforms therein and thus failure of creating precise waveforms.

Therefore, by creating a triangular wave in primary input waveform circuit 26 and supplying it to primary coil 21, voltages depending on a displacement of magnetic body 20 can be generated in secondary coils 22 and 23 without being affected by the inductance of primary coil 21. Then, the output voltages obtained from secondary coils 22 and 23 are rectified and smoothed in output detection circuit 27, and the voltages are set to be not greater than the voltage supplied to microcomputer 25. Thereafter, the voltages are inputted to A/D conversion ports 28 of microcomputer 25, and then microcomputer 25 determines a vibration based on the conversion result with a preset threshold of vibration. Then, controller 11 controls motor 5 based on the determination result. In addition, it is also possible to detect the weight of laundry in rotary drum 1 with the conversion result.

In accordance with the present invention described above, by detecting a vibration of the water tub in the washing machine directly by means of the vibration detecting unit, an occurrence of abnormal vibration or noise due to an imbalanced distribution of laundry in the rotary drum can be prevented during the water-extracting process. Furthermore, the weight of the laundry in the rotary drum can also be obtained from the detection result of the vibration detecting unit. With these advantages, the present invention can be applied to various washing machines used in household and commercial environments to wash and try laundries.

While the invention has been shown and described with respect to the preferred embodiments, it will be understood by those skilled in the art that various changes and modifications may be made without departing form the spirit and scope of the invention as defined in the following claims.

What is claimed is:

1. A washing machine comprising:

a rotary drum having a substantially horizontal or slanted rotational axis, for accommodating laundry therein;

a water tub movably supported in a washing machine main body, for accommodating the rotary drum therein rotatably;

a supporting metallic part for supporting the water tub;

a washing machine base for supporting the washing machine main body;

a motor for rotating the rotary drum;

a controller for controlling the motor; and a vibration detecting unit disposed between the supporting metallic part and the washing machine base, for detecting a vibration of the water tub, wherein the vibration detecting unit includes a differential transformer having a magnetic body, an input primary coil, and two output secondary coils disposed to be coaxial to the input primary coil, wherein the magnetic body is shaft-shaped and is movably disposed to pass through the three coils, wherein the two secondary coils generate respective voltage outputs of the vibration detecting unit in response to a constant input to the primary coil and a displacement of the magnetic body due to a movement thereof, and wherein the slopes of the respective voltage outputs of the two secondary coils per a unit displacement of the magnetic body are different from each other.

2. The washing machine of claim 1, further comprising an input setup unit for setting up operations of the washing machine, wherein the controller controls the operations set up by the input setup unit and controls the motor;

a primary input waveform circuit, wherein a triangular wave generated based on a voltage supplied to a microcomputer of the controller is inputted to the primary coil by the primary input waveform circuit; and an output detection circuit, wherein the voltage outputs of the two secondary coils are rectified and smoothed-and are set to be less than or equal to the voltage supplied to the microcomputer by the output detection circuit, wherein outputs of the output detection circuit are inputted to A/D conversion ports of the microcomputer.

3. The washing machine of claim 1, locations of the two secondary coils with respect to the primary coil are different from each other.

4. The washing machine of claim 1, one of the secondary coils, with a larger differential voltage output, is used in detecting an weight of the laundry and the other of the secondary coils, with a smaller differential voltage output, is used in detecting the vibration of the water tub.

5. The washing machine of claim 1, wherein said one of the secondary coils with the larger differential voltage output has a narrower detection range; and the other secondary coil with the smaller differential voltage output has a wider detection range.

* * * * *